US008732885B2

(12) United States Patent
Galindo Sanchez et al.

(10) Patent No.: US 8,732,885 B2
(45) Date of Patent: May 27, 2014

(54) ARRANGEMENT OF DEVICE FOR BACK MASSAGE

(75) Inventors: Francisco Javier Galindo Sanchez, Sant Esteve Sesrovires (Barcelona) (ES); Sergio Mezery, Barcelona (ES)

(73) Assignee: Paten pro Dax Group, S.L., Sant Esteve Sesrovires, Barcelona ( * ) Notice: Subject to any disclaimer, the term of this patent is extended or adjusted under 35 U.S.C. 154(b) by 470 days.

(21) Appl. No.: 13/123,639

(22) PCT Filed: May 12, 2009

(86) PCT No.: PCT/ES2009/000255

§ 371 (c)(1),
(2), (4) Date: Apr. 11, 2011

(87) PCT Pub. No.: WO2010/061012

PCT Pub. Date: Jun. 3, 2010

(65) Prior Publication Data

US 2011/0196273 A1 Aug. 11, 2011

(30) Foreign Application Priority Data

Nov. 3, 2008 (ES) ..... 200803129

(51) Int. Cl.
*A47K 7/04* (2006.01)

(52) U.S. Cl.
USPC ..... 15/34; 15/21.1

(58) Field of Classification Search
CPC ..... A47L 23/02; A47L 23/263; A01G 1/125
USPC ..... 15/21.1, 180, 88.3, 88.4, 34; 4/606; 601/118
See application file for complete search history.

(56) References Cited

U.S. PATENT DOCUMENTS

| | | | | |
|---|---|---|---|---|
| 2,068,757 | A | 1/1937 | Mishelle | |
| 3,196,867 | A | 7/1965 | Perry | |
| 3,372,604 | A | 3/1968 | Perry | |
| 4,040,132 | A * | 8/1977 | Braun | 4/606 |
| 5,345,640 | A | 9/1994 | Goss | |
| 8,245,344 | B2 * | 8/2012 | Kilpatrick | 15/21.1 |

FOREIGN PATENT DOCUMENTS

| | | | |
|---|---|---|---|
| ES | 2 249 195 | B1 | 3/2006 |
| FR | 2347001 | * | 11/1977 |

OTHER PUBLICATIONS

International Search Report (PCT/ISA/210) issued on Oct. 9, 2009, by Spanish Patent Office as the International Searching Authority for International Application No. PCT/ES2009/000255.
Written Opinion (PCT/ISA/237) issued on Oct. 9, 2009, by Spanish Patent Office as the International Searching Authority for International Application No. PCT/ES2009/000255.

* cited by examiner

*Primary Examiner* — Robert Scruggs
(74) *Attorney, Agent, or Firm* — RatnerPrestia

(57) ABSTRACT

A back massage device comprises multiple rotary brushes mounted on a support, whereby the brushes are driven mechanically by a motor system and the support is embedded in a wall. The device includes a system for moving the brushes perpendicularly to the wall, such that the device can occupy a stowed position in which the brushes do not protrude from the wall and an operating position in which the brushes protrude from the wall.

7 Claims, 6 Drawing Sheets

ARRANGEMENT OF DEVICE FOR BACK MASSAGE

The present invention relates to a back massage device which has notable characteristics of novelty and inventive step.

The purpose of the device according to the present invention is to perform massages on the back portion of the body for comfort or relaxation and/or pre-therapeutic purposes on the back area, particularly the muscular areas.

Document ES2249195 discloses a device with the aforementioned characteristics, which comprises multiple rotary brushes on a support, the brushes being driven mechanically by a motor system.

The device according to the present invention is designed for placing in a fixed position in bath or shower areas.

In said areas, space is a major problem. Known devices for back massage are bulky and occupy significant space in the already limited space normally found in bath and shower areas.

The present invention aims to provide a solution to this problem, disclosing solutions which afford an effective saving of space based on the integration of the device in the wall.

In particular, the present invention consists of a back massage device of the type that comprises multiple rotary brushes mounted on a support, the brushes being driven mechanically by a motor system and the support being embedded in a wall of a shower area. Preferably, the support has a portion designed to be arranged in the wall and an outer border to cover the wall-device interface. Said device is known from documents U.S. Pat. Nos. 4,040,132A and 2,068,757A.

By means of integration in the wall an evident saving of space is achieved.

Since the wall is usually a location which is relatively isolated from the shower, the addition of a motor system which drives the rollers is especially relevant.

To save even more space, it is particularly preferred according to the present invention that the device includes an automatic system for moving the brushes perpendicularly to the wall, such that the device is capable of occupying a stowed position in which the cylinders do not protrude from the wall and an operating position in which the brushes protrude from the wall. Accordingly and in a particularly preferred manner, the automatic system for moving the brushes comprises a structure that houses the brushes and that has the ability to be moved relative to a fixed portion of the support by means of a reverse crank and connecting rod mechanism.

To achieve the aforementioned movement, the present invention also discloses a particularly simple reverse crank and connecting rod mechanism suitable for the limited space in which it is to be situated. In particular, the reverse crank and connecting rod system comprises a disk driven by a motor to which is connected eccentrically and by means of a pivot joint, a bar or connecting rod which is connected by means of another pivot joint to the structure which houses the brushes.

Preferably, to assist said mechanism, movement guides are provided between the structure that houses the brushes and the fixed portion. Said guides may simply consist of bolts housed in seats in the direction of movement of the portion that houses the brushes. Preferably, four of said guides are provided, although other quantities are possible.

For a better understanding, the accompanying drawings show an embodiment of the back massage device according to the present invention as an explanatory but not limiting example.

Figure 1:
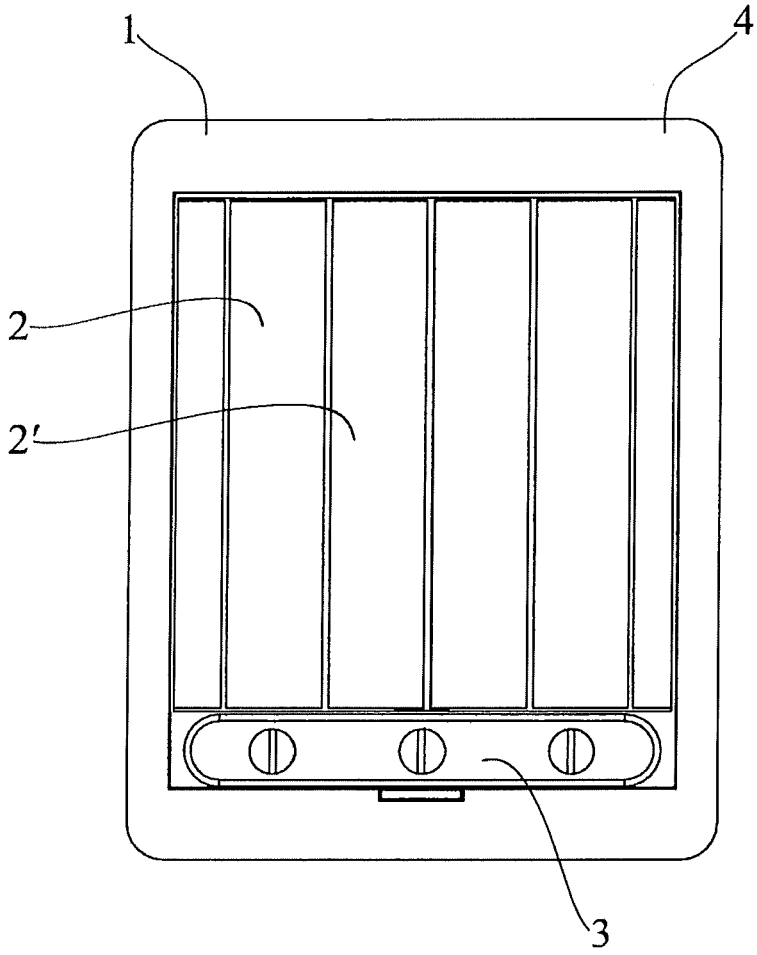
FIG. 1 is a view in front elevation of a device according to the present invention for embedding in a wall.
Figure 2:
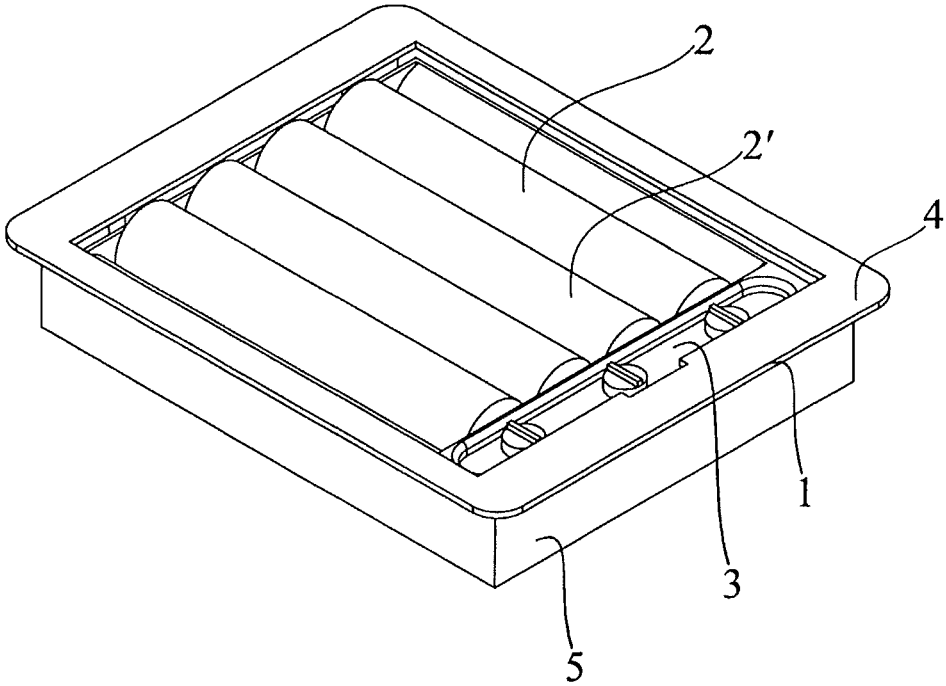
FIG. 2 is a perspective view of the device with the brushes in the stowed position.
Figure 3:
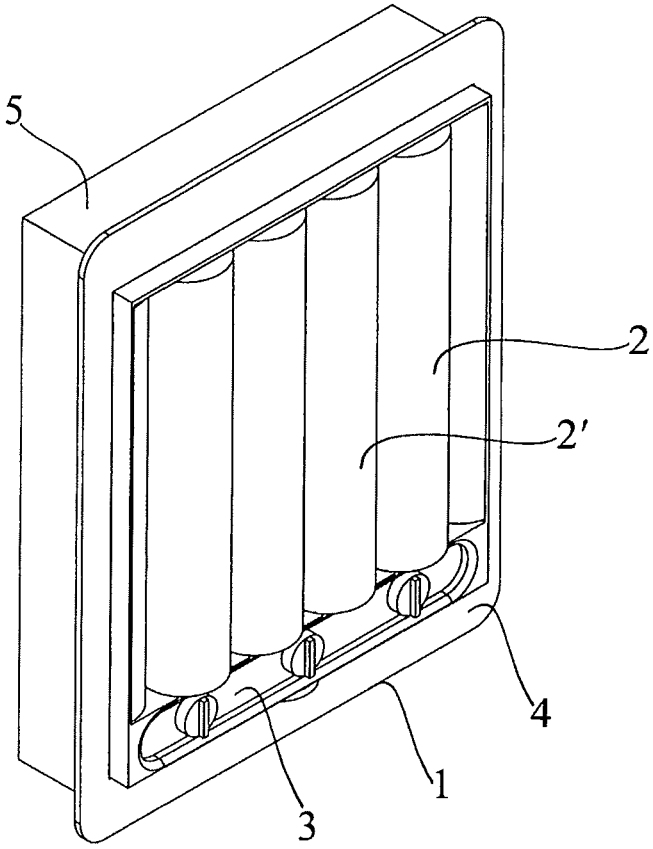
FIG. 3 is another perspective view of the device with the brushes in the extended position protruding from the rest of the device.
Figure 4:
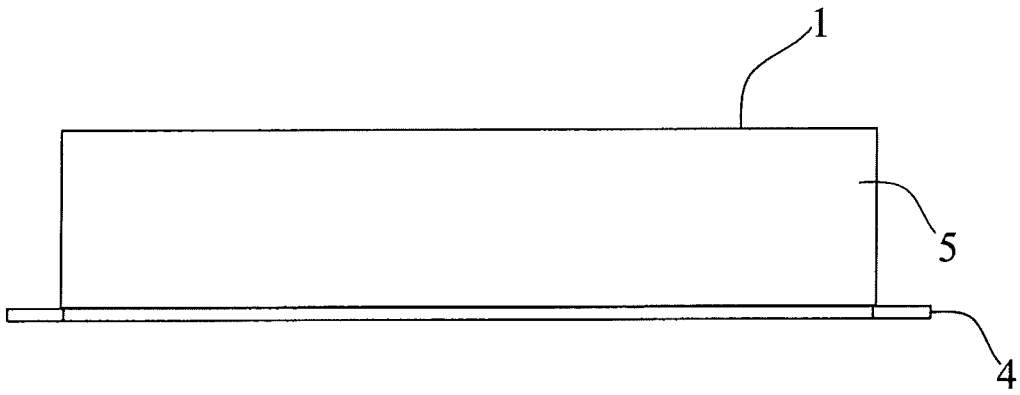
FIG. 4 is a view from above of the device with the brushes in the stowed position.
Figure 5:
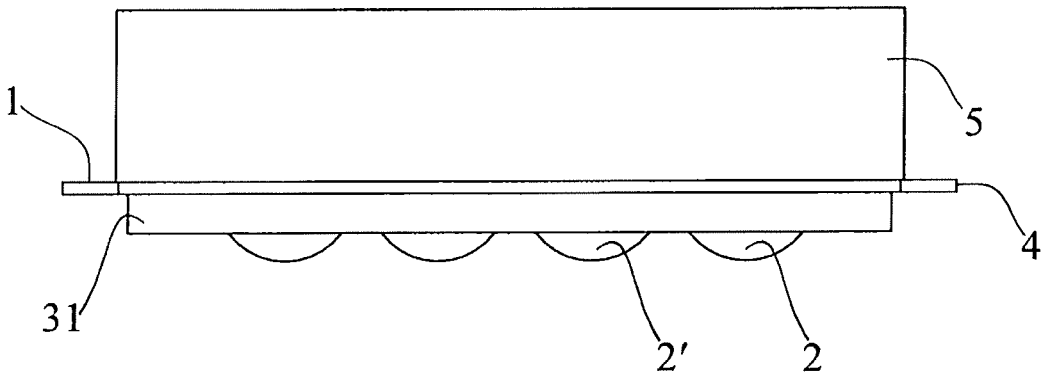
FIG. 5 is a view from above of the device with the brushes in the extended position.

The figures show a back massage device which is suitable for embedding in a wall of a bathroom. The device comprises rotary brushes 2, 2' which in this case have a cylindrical form, but which may have any other form, as mentioned, for example, in document E52249195. Although not shown in the figures, the brushes can be rotated by means of a motor system, for example, as shown in the aforementioned publication.

The brushes 2, 2' are located in a support 1 which protects the internal mechanisms. The support 1 comprises a portion 5 designed to be arranged in the wall and a flange 4 to cover the wall-device interface once said device has been embedded.

As seen in the figures, the brushes 2, 2' can move perpendicularly to the embedding wall in such a way that in the stowed position the cylinders do not protrude from the wall (in this case they do not protrude from the flange 4), but in the extended position they do protrude. The support 1 therefore comprises a movable structure 31 which houses the brushes 2, 2' and a fixed portion of the support 4, 5 which can move relative to each other.

Figure 6:
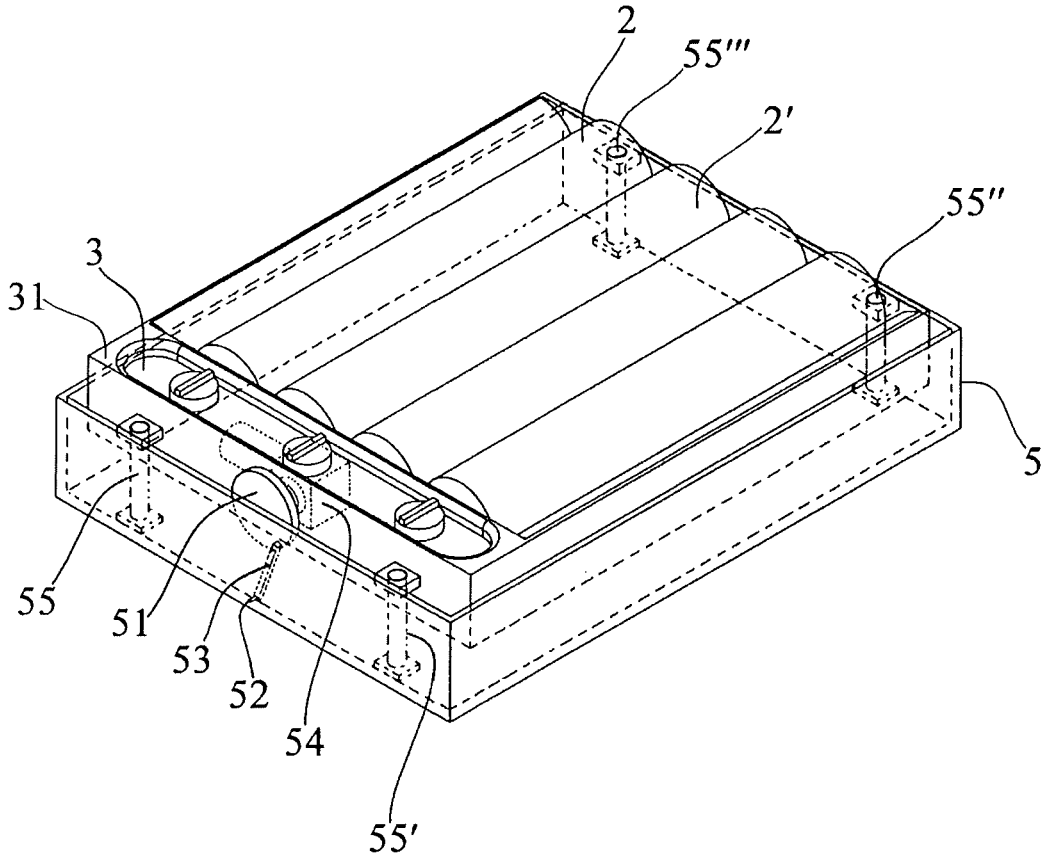
FIG. 6 is a perspective view of the device, showing the internal mechanism which allows the brushes to be stowed and extended.

In FIG. 6 a mechanism can be seen which allows the relative movement between the movable structure 31 and the fixed portion 4, 5 of the support 1 (for the sake of clarity the flange 4 has not been illustrated). The mechanism comprises a motor 54 which causes rotation of a disk 51 to which a bar 53 is eccentrically and hingedly connected (pivot joint). This bar is also hingedly connected to the fixed portion 5 in a pivot joint 52. Both the motor 54 and the disk 51 are located in the movable portion 31. To achieve the movement, four guides 55, 55', 55", 55'" have been arranged, consisting of bolts housed in seats (or pockets) arranged in the direction of movement of the fixed portion.

The device also has a control zone 3 situated in the movable portion 31. From there, the user can actuate the device to place it in the stowed or operating position, actuate the brushes at different speeds, etc.

Although the invention has been described with respect to preferred embodiments, these should not be considered as limiting the invention, which is defined by the broadest interpretation of the following claims.

The invention claimed is:

1. A back massage device comprising:

a support that is embedded in a wall and an outer border that covers a wall-device interface, the support comprising a movable structure that houses multiple rotary brushes and moves the brushes perpendicular to the wall, the brushes driven mechanically by a motor system;

wherein, at a stowed position of the device, the brushes do not protrude from the wall and at an operating position of the device, the brushes protrude from the wall.

2. A device according to claim 1, further comprising an outer flange to cover the wall-device interface.

3. A device according to claim 1, wherein the movable structure moves relative to a fixed portion of the support by means of a reverse crank and connecting rod mechanism.

4. A device according to claim 3, wherein the reverse crank and connecting rod system comprises a disk driven by a motor to which is connected eccentrically and by means of a pivot joint, a bar or connecting rod which is connected by means of another pivot joint to the structure which houses the brushes.

5. A device according to claim 3, wherein movement guides are provided between the structure and the fixed portion.

6. A device according to claim 5, wherein said guides consist of bolts housed in seats arranged in the direction of movement of the portion that houses the brushes.

7. A device according to claim 5, wherein the device has four of said guides.

* * * * *